US006537101B1

(12) United States Patent
Wang

(10) Patent No.: US 6,537,101 B1
(45) Date of Patent: Mar. 25, 2003

(54) ELECTRIC CORD CONNECTOR

(76) Inventor: Gordan Wang, No. 20, Alley 23, Lane 118, Kao-Yuan Rd., Chung-Ho Village, Lung-Ching Hsiang, Taichung Hsien (TW)

( * ) Notice: Subject to any disclaimer, the term of this patent is extended or adjusted under 35 U.S.C. 154(b) by 0 days.

(21) Appl. No.: 10/003,131

(22) Filed: Nov. 15, 2001

(51) Int. Cl.[7] ..... H01R 4/24
(52) U.S. Cl. ..... 439/417
(58) Field of Search ..... 439/417, 419, 439/280, 558, 402, 405, 404, 602, 605, 395

(56) References Cited

U.S. PATENT DOCUMENTS 5,954,534 A * 9/1999 Hale et al. ..... 439/409

* cited by examiner

*Primary Examiner*—Renee Luebke
*Assistant Examiner*—Phuongchi Nguyen
(74) *Attorney, Agent, or Firm*—Pearne & Gordon LLP

(57) ABSTRACT

An electric cord connector includes a base member that has a groove diametrically defined to receive an electric cord. Two contacts are respectively inserted into a bottom of the groove and electrically connected to a domestic appliance. Each contact has a sharpened end extending into the groove and aligns with a corresponding one of the two copper wires. A clamping block includes a presser to be received in the groove. The presser presses and holds the cord and the sharpened ends of the two contacts respectively cut through the insulating coating and electrically connecting to a corresponding one of the two copper wires of the cord so that the user does not need to cut off the insulating coating before connecting the cord to a domestic appliance.

6 Claims, 6 Drawing Sheets

ELECTRIC CORD CONNECTOR

BACKGROUND OF THE INVENTION

1. Field of the Invention

The present invention relates to a connector, and more particularly to an electric cord connector that can safely and quickly connect a cord and domestic appliances.

2. Description of Related Art

Electric cords for household use usually has an insulating coating covering two copper wires to protect the user from an electric shock or prevent a short circuit. The insulating coating must be cut off before electrically connecting the cord to a domestic appliance.

With reference to FIG. 6, a conventional lamp socket (50) includes a connector (51), a first cover (52) and a second cover (53). The first cover (52) and the second cover (53) are made of insulating material and abut each other to form a chamber to hold the connector (51). The connector (51) includes an insulating block (510), a first contact (512) and a second contact (513). The first contact (512) and the second contact (513) are separately secured in the insulating block (510). A conductive sleeve (511) is electrically connected to one of the two contacts (512, 513) so a bulb (70) can be screwed into the lamp socket (50). A rotating switch (514) is mounted in the connector (51) to selectively turn on the bulb (70). An electric cord (60) has two copper wires (62) respectively electrically connected to and secured on the first contact (512) and the second contact (513). Each wire has an insulating coating around the wire (62).

Before the wires (62) can be electrically connected to the contacts (512, 513), the insulating coating (61) must be cut off to bare the copper wires (62). However the two copper wires (62) may be damaged when cutting off the insulating coating (61). The first contact (512) and the second contact (513) carry the total weight of the bulb (70) and the lamp socket (50) when the bulb (70) hung from a ceiling. A knob is tied in the cord (60) to abut the first cover (52) and take the load off the copper wires (62) and keep them from detaching from the contacts (512, 513). The technique is inexact and can be very inconvenient.

The present invention has arisen to mitigate and/or obviate the disadvantage of the conventional cord connector.

SUMMARY OF THE INVENTION

The main object of the present invention is to provide an improved electric cord connector that connects the cord and domestic appliances safely and quickly.

To achieve the objective, the electric cord connector in accordance with the present invention includes a base member that has a groove diametrically defined to receive an electric cord. Two contacts are respectively inserted into a bottom of the groove and electrically connected to a domestic appliance. Each contact has a sharpened end extending into the groove and aligns with a corresponding one of the two copper wires. A clamping block includes a presser extending into the groove. The presser presses and holds the cord and the sharpened ends of the two contacts respectively break through the insulating coating and electrically connecting to the corresponding copper wire of the cord.

Further benefits and advantages of the present invention will become apparent after a careful reading of the detailed description with appropriate reference to the accompanying drawings.

DETAILED DESCRIPTION OF PREFERRED EMBODIMENT

Figure 1:
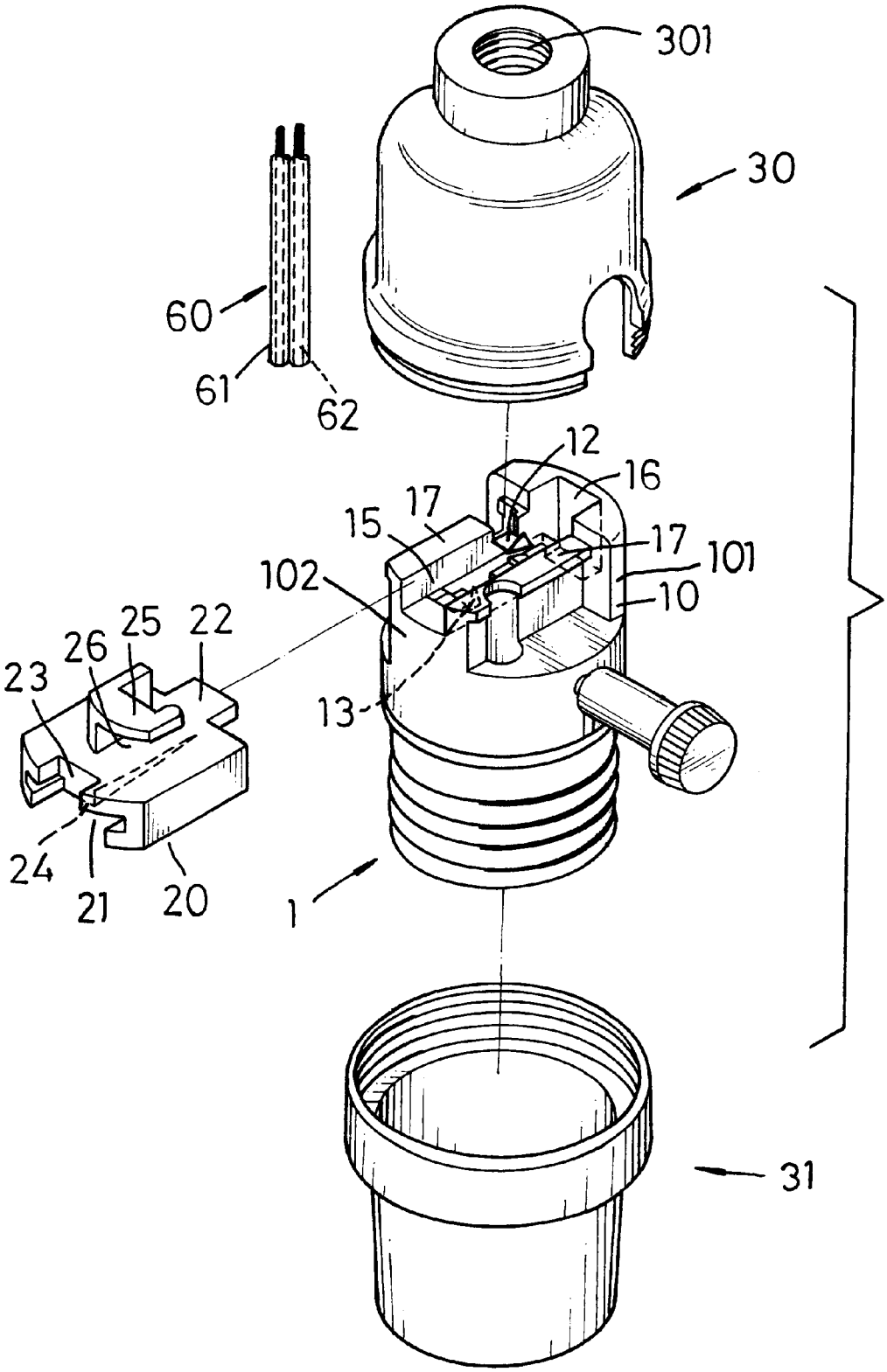
FIG. 1 is an exploded perspective view of an electric cord connector in accordance with the present invention.

With reference to the drawings and initially to FIG. 1, an electric cord connector in accordance with the present invention comprises a base member (10) and a clamping block (20) detachably mounted on the base member (10).

The base member (10) comprises a limit stop (101) extending upward from an edge of the base member (10) and a connecting block (102) diametrically formed on and extending up from the base member (10) and integrally connected to the limit stop (101). A groove (15) is longitudinally defined in the connecting block (102). The groove (15) includes an open end (not numbered) at one end of the connecting block (102) and a closed end (not numbered) extending into the limit stop (101). The limit stop (101) has a cavity (16) defined perpendicular to the groove (15) and communicating with the groove (15) to receive a free end of an electric cord (60). The groove (15) has a width adapted to receive the electric cord (60) that includes a two parallel copper wires (62) and an insulating coating (60) separately covering the two copper wires (62). A first contact (12) and a second contact (13) are respectively attached to the bottom of the groove (15) and axially extending through the base member (10) the first contact (12) and the second contact (13) respectively align with a corresponding one of the two copper wires (62) and each has a sharpened top extending into the groove (15) in the base member (10). The base member (10) includes two rails (17) laterally extending from the top of two opposite sides of the connecting block (102).

The clamping block (20) is slidably attached to the base member (10) and comprises a T-shaped groove (21) defined to partially receive the connecting block (102) the T-shaped groove (21) includes a horizontal portion defined to slidably receive the two rails (17) of the base member (10) and a vertical portion defined to partially receive the connecting block (102). A tab (22) laterally extends from the clamping block (20) into the cavity (16) in the limit stop (101) a recess (23) is defined in the connecting block (20). The recess (23) aligns with the tab (22) and communicates with the T-shaped groove (21) allowing the cord (60) to pass through the clamping block (20). A wedge-shaped presser (24) extends from the clamping block (20) longitudinally into the T-shaped groove (21) so that the presser (24) is received in the groove (15) in the base member (10). The presser (24) includes a tapered bottom facing the groove (1 5) in the base member (10).

Figure 2:
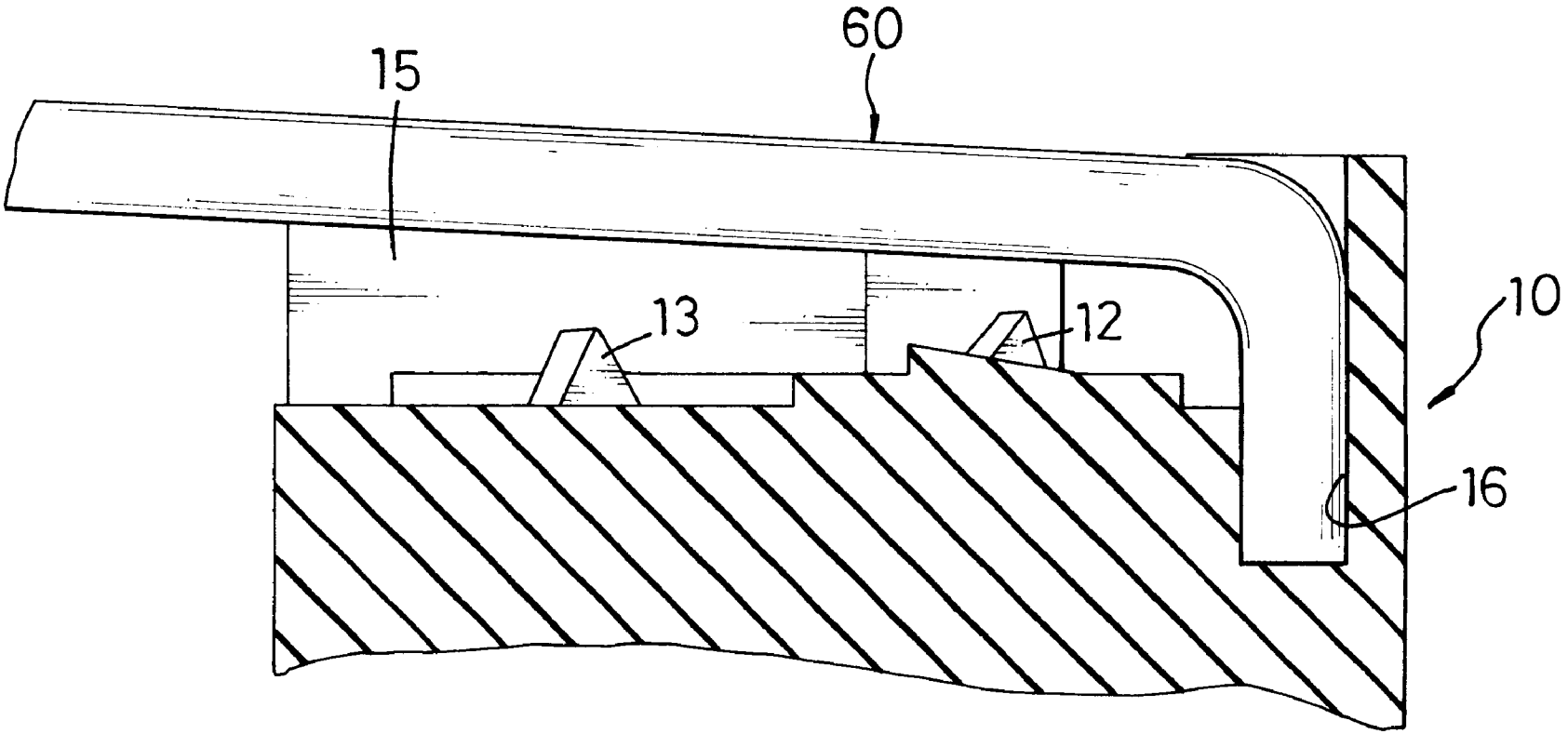
FIG. 2 is a side plan view in partial section of the connecting block in FIG. 1 before a cord electrically connected.
Figure 3:
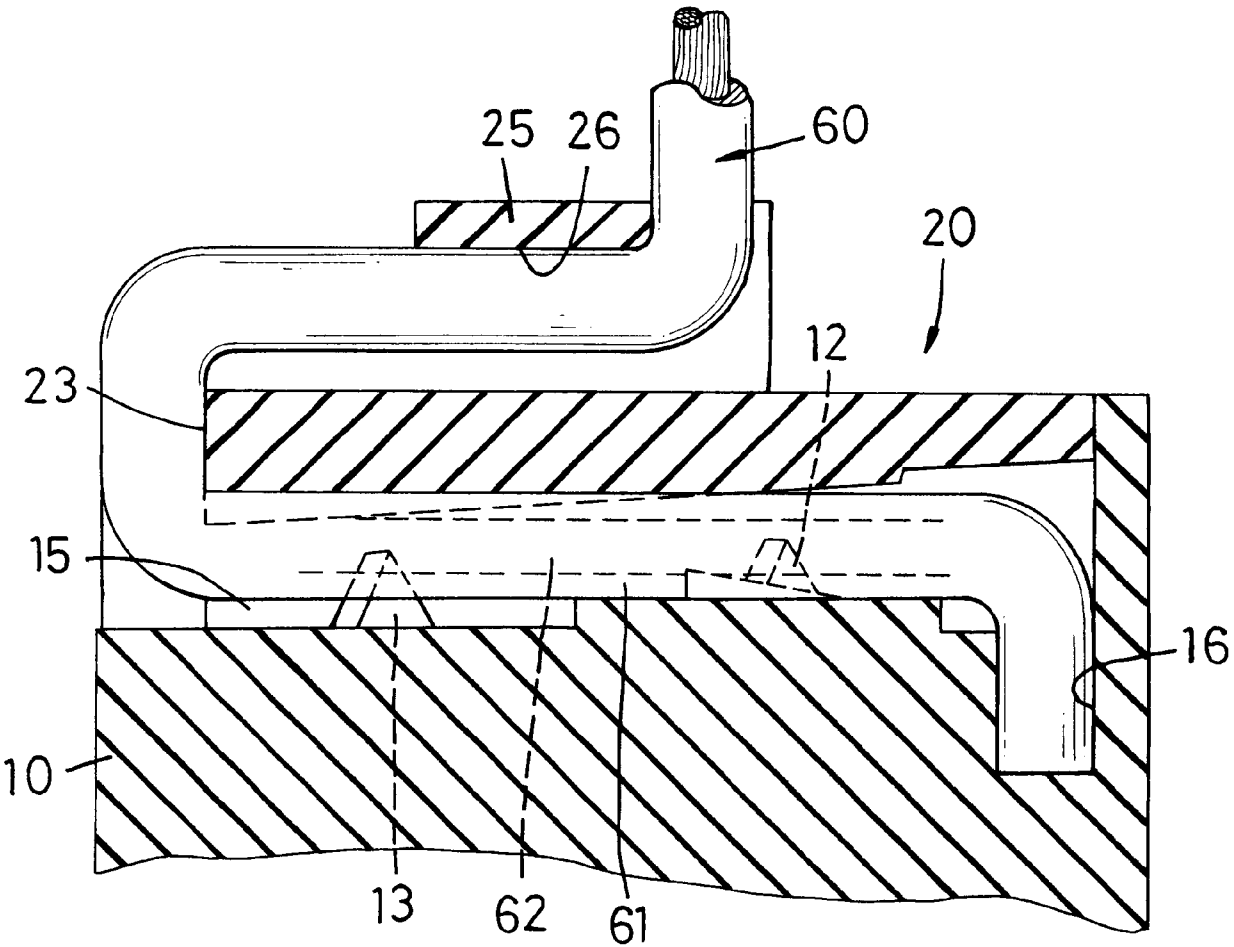
FIG. 3 is a side plan view in partial section of the electric cord connector in FIG. 1.
Figure 4:
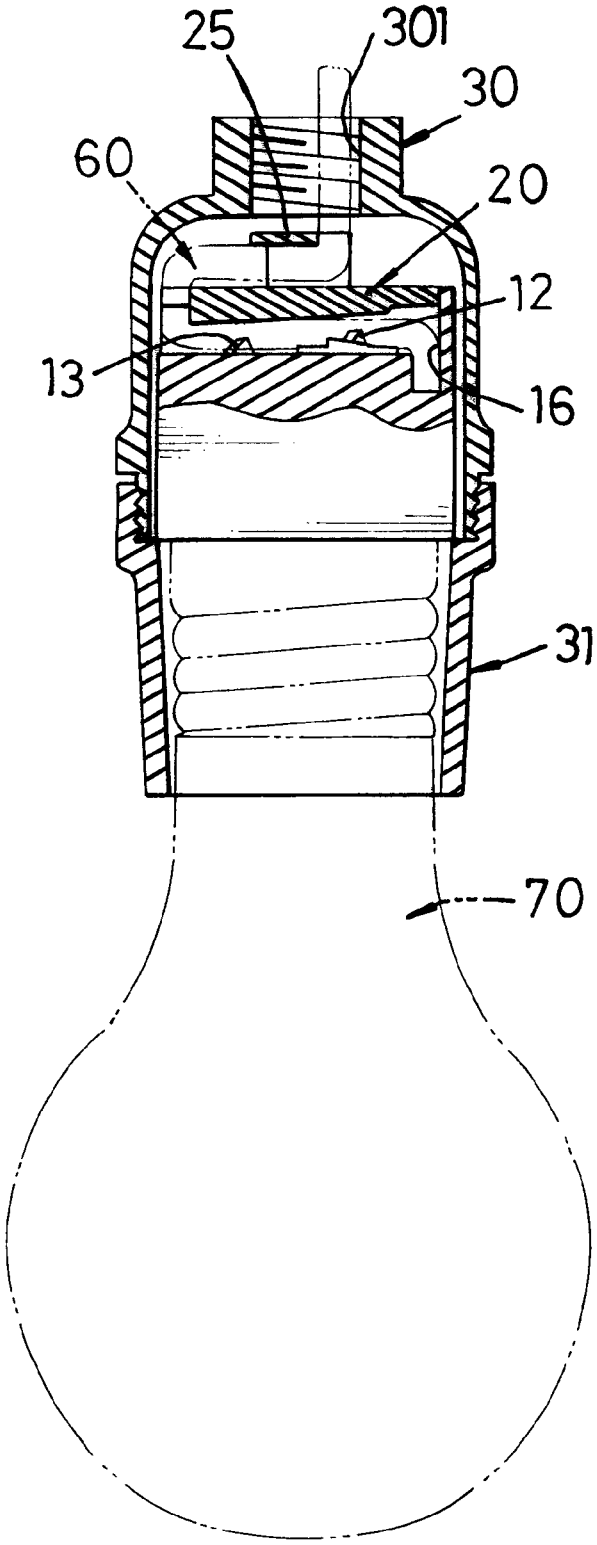
FIG. 4 is a cross sectional view of the electric cord connector in FIG. 1.

With reference to FIGS. 2 and 3, the cord (60) in put into the groove (15) and is pressed to make the sharpened tops of the contacts (12, 13) cut through the insulating coating (61) into the copper wires (62). By doing so, the first contact (12) and the second contact (13) are respectively electrically connected to the corresponding copper wire (62). Then the cord (60) is tightly pressed between the presser (24) and the bottom of the groove (15) after the clamping block (20) in mounted on the base member (10). It is unnecessary to cut away the insulating coating (61) and bare the copper wire (62) before the cord (60) is connected to the contacts (12, 13). With reference to FIGS. 1 and 4, the electric cord connector in accordance with the present invention is adapted to be used in a lamp socket (1) that includes a first cover (30) and a second cover (31) abutting each other to form a chamber to hold the electric cord connector. The first cover (30) of the lamp socket (1) has a through hole (301) centrally defined in the top of the first cover (30) to allow the cord extending through the first cover (30). The clamping block (20) includes an L-shaped hook (25) with one end connected to the top of the clamping block (20) and corresponding to the through hole (301) in the first cover (30) and the recess (23) in the clamping block (20) so that a passage (26) is formed between the top of the clamping block (20) and the hook (25). After the cord (60) extending through the through hole (301) in the first cover, the cord (60) is held in place by passing through the passage (26) under the hook (25) and bent through the recess (23) in the clamping block (20) into the groove (15) in the connecting block (102) this makes the cord (60) unnecessary to tie a knot in the cord (60) to abut the periphery of the through hole (301) in the first cover (30) to prevent the copper wires (62) from detaching from the contacts (12, 13) when the lamp socket is hung from a ceiling.

Figure 5:
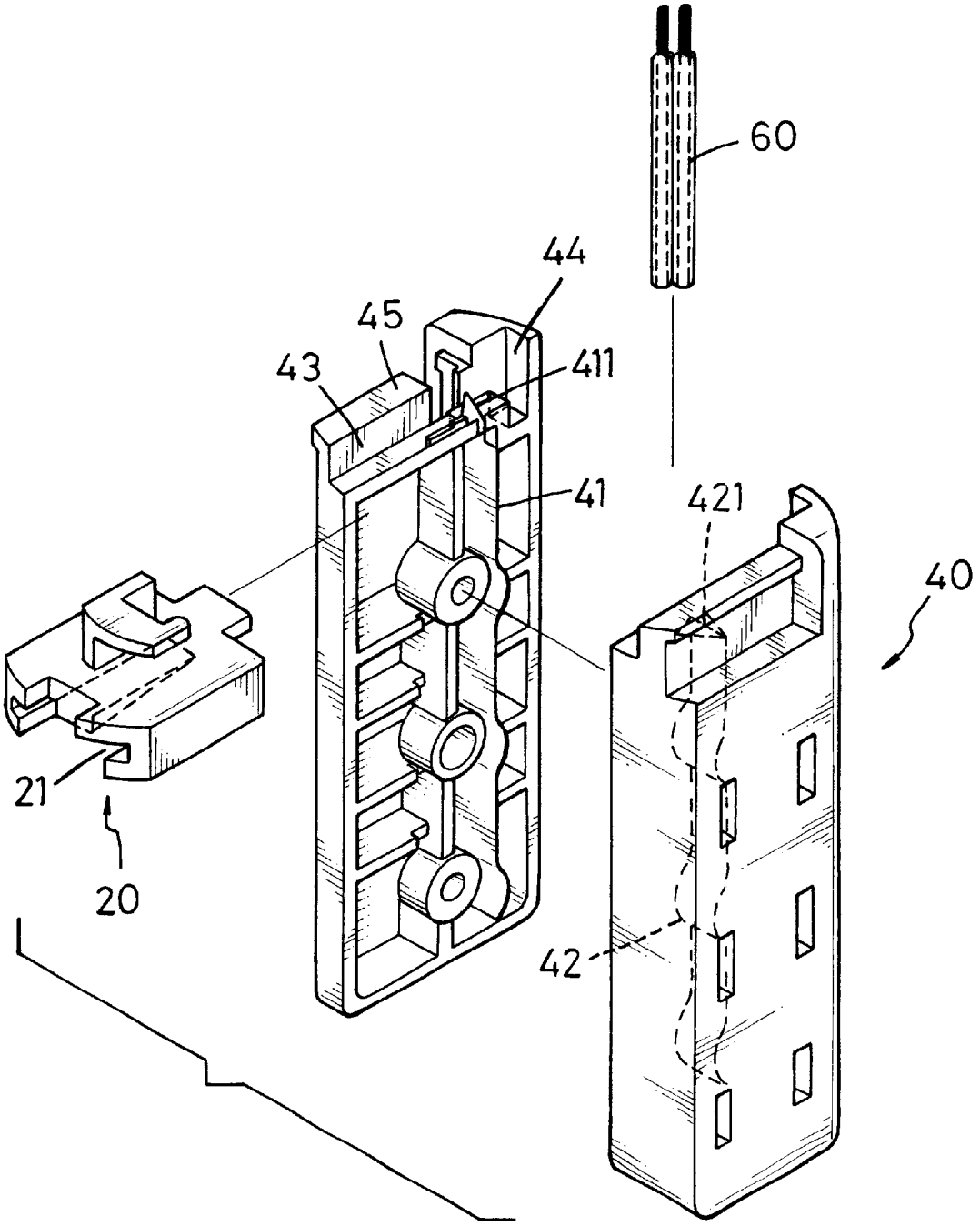
FIG. 5 is an exploded perspective view of another embodiment of an electric cord connector in accordance with the present invention.
Figure 6:
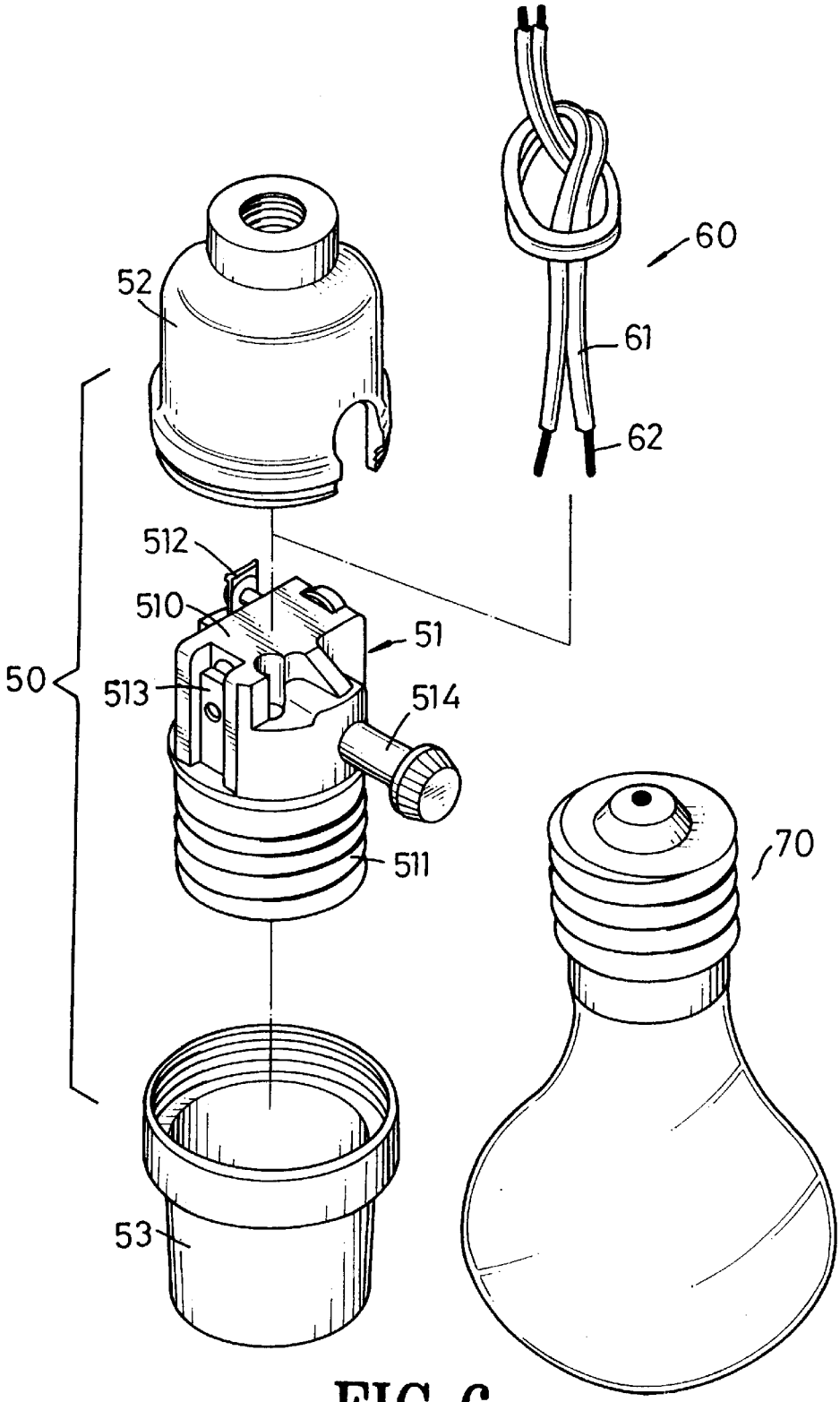
FIG.6 PRIOR ART
FIG. 6 is an exploded perspective view of a conventional electric cord connector.

With reference to FIG. 5, the electric cord connector in accordance with the present invention is adapted to be used on an extension cord socket (40) and includes two casing shells (not numbered) abutting each other. Each casing shell has a shoulder (43) facing each other and defining a groove (not numbered) after the two casing shells abutting each other. Each casing shell includes a rail (45) laterally extending out from the top of the casing shell. Two contacting strips (41, 42) are respectively received in a corresponding one of the two casing shells and parallel to each other. Each contacting strip (41, 42) has a sharpened distal end (411, 421) extending through a bottom of the groove to electrically connect to the copper wire (62) in the cord (60) after the clamping block (20) being slidably mounted on the rail (45) of the socket (40).

Although the invention has been explained in relation to its preferred embodiment, it is to be understood that many other possible modification and variation can be made without departing from the spirit and scope of the invention as hereinafter claimed.

What is claimed is:

1. An electric cord connector comprising:

a base member including;

a groove diametrically defined in the base member and adapted to receive an electric cord that has two copper wires and an insulating coating covering and separating the two copper wires, the groove having at least one end extending to an outer periphery of the base member;

two contacts respectively inserted into a bottom of the groove and adapted to be electrically connected to a domestic appliance, each contact having a sharpened end extending into the groove in the base member and adapted to align with a corresponding one of the two copper wires; and a limit stop extending upward from an edge of the base member and a connecting block diametrically extending upward from the base member, and the groove is longitudinally defined in the connecting block, the groove including an open end at an outer periphery of the base member and a closed end in the limit stop, the limit stop having a cavity defined periphery to the groove and communicating with the groove, the cavity adapted to receive a free end of the cord; and a clamping block slidably attached to the base member, the clamping block including:

a presser extending from the clamping block and received in the groove in the base member after the clamping block being mounted on the base member, the presser adapted to press and hold the cord and the sharpened ends of the two contacts respectively breaking through the insulating coating and electrically connecting to a corresponding one of the two copper wires of the cord;

a recess defined in the clamping block and communicating with the groove in the base member, the recess adapted to allow the cord passing through the clamping block; and an L-shaped hook with one distal end connected to a top of the clamping block and corresponding to the recess in the clamping block so that a passage is formed between the top of the clamping block and the L-shaped hook.

2. The electric cord connector as claimed in claim 1, wherein the connecting block of the base member includes a top with two opposite sides each having a rail laterally extending from the connecting block, and the clamping block includes a T-shaped groove having a horizontal portion defined to receive the rails of the connecting block and a vertical portion defined to receive the connecting block of the base member.

3. The electric cord connector as claimed in claim 2, wherein the presser of the clamping block longitudinally extends into the T-shaped groove in the clamping block and is movably received in the groove in the base member.

4. The electric cord connector as claimed in claim 1, wherein the clamping block comprises a tab laterally extending to correspond to and be received in the cavity in the limit stop.

5. The electric cord connector as claimed in claim 4, wherein the connecting block of the base member includes a top with two opposite sides each having a rail laterally extending from the connecting block, and the clamping block includes a T-shaped groove having a horizontal portion defined to receive the rails of the connecting and a vertical portion defined to receive the connecting block of the base member.

6. The electric cord connector as claimed in claim 5, wherein the presser of the clamping block longitudinally extends into the T-shaped groove in the clamping block and is movably received in the groove in the base member.

* * * * *